US008844462B2

(12) United States Patent
Onozawa et al.

(10) Patent No.: US 8,844,462 B2
(45) Date of Patent: Sep. 30, 2014

(54) PRODUCTION FACILITY AND PRODUCTION PROCESS FOR HOT DIP GALVANNEALED STEEL PLATE

(71) Applicant: Nippon Steel & Sumitomo Metal Corporation, Tokyo (JP)

(72) Inventors: Hajime Onozawa, Tokyo (JP); Yoshitaka Kimura, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 13/765,921

(22) Filed: Feb. 13, 2013

(65) Prior Publication Data

US 2013/0213298 A1 Aug. 22, 2013

Related U.S. Application Data

(63) Continuation of application No. 12/440,177, filed as application No. PCT/JP2007/069784 on Oct. 3, 2007, now Pat. No. 8,402,909.

(30) Foreign Application Priority Data

Oct. 13, 2006 (JP) ..... 2006-280593

(51) Int. Cl.

| | |
|---|---|
| ***C23C 2/28*** | (2006.01) |
| ***C23C 2/26*** | (2006.01) |
| ***C23C 2/00*** | (2006.01) |
| ***C21D 1/40*** | (2006.01) |
| ***C21D 9/56*** | (2006.01) |
| ***F27B 9/28*** | (2006.01) |
| ***C21D 9/573*** | (2006.01) |
| ***C23C 2/06*** | (2006.01) |

(52) U.S. Cl.

CPC . *C23C 2/003* (2013.01); *C21D 1/40* (2013.01); *C23C 2/26* (2013.01); *C21D 9/56* (2013.01); *C21D 9/562* (2013.01); *C23C 2/00* (2013.01); *F27B 9/28* (2013.01); *C21D 9/573* (2013.01); *C23C 2/28* (2013.01); *C23C 2/06* (2013.01); *C23C 2/285* (2013.01)

USPC ..... 118/67; 118/66; 118/58

(58) Field of Classification Search

None

See application file for complete search history.

(56) References Cited

U.S. PATENT DOCUMENTS

| | | | | |
|---|---|---|---|---|
| 5,628,842 | A | 5/1997 | Wilmotte et al. | |
| 6,426,122 | B1 * | 7/2002 | Ishii et al. | 427/433 |
| 6,536,254 | B1 * | 3/2003 | Kawalla et al. | 72/200 |

FOREIGN PATENT DOCUMENTS

| | | | | |
|---|---|---|---|---|
| EP | 0 360 958 | A2 | 4/1990 | |
| JP | 63-121644 | * | 5/1988 | C23C 2/28 |

(Continued)

OTHER PUBLICATIONS

Advisory Action dated May 9, 2012 in U.S. Appl. No. 12/440,177.

(Continued)

*Primary Examiner* — Dah-Wei D Yuan
*Assistant Examiner* — Jethro Pence
(74) *Attorney, Agent, or Firm* — Birch, Stewart, Kolasch & Birch, LLP

(57) ABSTRACT

The present invention provides a production facility of hot dip galvannealed steel plate able to produce hot dip galvannealed steel plate on production conditions optimal at all times despite rapid changes in the steel type, plating deposition, and other external factors, wherein the production facility 1 of hot dip galvannealed steel plate is provided with a soaking/cooling furnace 7 for treating steel plate I running after leaving a rapid heating furnace 6 by at least one of soaking and cooling. Further, the soaking/cooling furnace 7 is configured to enable a change of the ratio in the furnace of the soaking region 15 for soaking steel plate I by soaking means 21 at a soaking temperature of 500° C. to 650° C. and the cooling region 16 for cooling the steel plate I by spray nozzles 22 by a 5° C./sec or more average cooling rate.

5 Claims, 5 Drawing Sheets

(56) References Cited

FOREIGN PATENT DOCUMENTS

| | | | |
|---|---|---|---|
| JP | 1-283352 | A | 11/1989 |
| JP | 2-277758 | A | 11/1990 |
| JP | 5-179415 | A | 7/1993 |
| JP | 63-121644 | A | 5/1998 |
| JP | 10-298730 | A | 11/1998 |
| JP | 3400289 | B2 | 4/2003 |

OTHER PUBLICATIONS

Extended European Search Report, dated Mar. 16, 2011, for European Application No. 07829522.7.

Final Office Action dated Feb. 17, 2012 in U.S. Appl. No. 12/440,177.

International Search Report for PCT/JP2007/069784, dated Jan. 8, 2008.

Non-Final Office Action dated Aug. 4, 2011 in U.S. Appl. No. 12/440,177.

Non-Final Office Action dated Jul. 9, 2012 in U.S. Appl. No. 12/440,177.

Non-Final Office Action dated May 12, 2011 in U.S. Appl. No. 12/440,177.

Notice of Allowance dated Nov. 26, 2012 in U.S. Appl. No. 12/440,177.

* cited by examiner

PRODUCTION FACILITY AND PRODUCTION PROCESS FOR HOT DIP GALVANNEALED STEEL PLATE

This application is a Continuation Application of U.S. patent application Ser. No. 12/440,177, filed Mar. 5, 2009, which is the U.S. National Phase of PCT/JP2007/069784, filed Oct. 3, 2007. Priority is claimed thereto under 35 U.S.C. §120. This application also claims priority under 35 U.S.C. §119(a) to Japanese Patent Application No. 2006-280593, filed in Japan on Oct. 13, 2006. The entire contents of all are herein incorporated by reference.

TECHNICAL FIELD

The present invention relates to a production facility for producing hot dip galvannealed steel plate by dipping steel plate in a plating bath, then alloying it in the plating bath and a process for production of hot dip galvannealed steel plate using this facility.

BACKGROUND ART

When producing hot dip galvannealed steel plate using a production facility of hot dip galvannealed steel plate, first, the steel plate is dipped in a plating bath filled with 440 to 480° C. molten zinc in a plating bath tank, then gas wiping nozzles spray the two surfaces of the steel plate with gas so as to adjust the plating deposition on the surfaces of the steel plate. Next, after adjusting the deposition, the steel plate is cooled to 400 to 460° C. or so, then heated again in an alloying furnace to 480 to 650° C. to make the iron in the steel plate and the deposited zinc react to thereby obtain an iron-zinc alloy plated steel plate. In general, the alloy layer of hot dip galvannealed steel plate is mainly comprised of the inferior sliding performance ζ-phase, superior sliding performance $\delta_1$-phase, and inferior adhesion Γ-phase. It is best to obtain an alloy layer mainly comprised of the superior sliding performance and adhesion $\delta_1$-phase.

The alloy phase formed by the alloying reaction differs depending on the temperature of the steel plate. It is known that the superior sliding performance and adhesion $\delta_1$-phase of steel plate is obtained near 490 to 650° C. In the conventional process of production of hot dip galvannealed steel plate, steel plate was heated in the alloying furnace (that is, the heating zone) of the alloying facility to 490 to 650° C., but the heating rate was slow, so the steel plate ended up being held for a long time at 470 to 490° C. (generally called the "ζ-phase forming temperature") in the heating process. For this reason, a process of forming a large amount of ζ-phase at the steel plate surface, then transforming the ζ-phase to the $\delta_1$-phase was employed. In this case, the alloy crystals at the steel plate surface are mainly ζ-phase-derived needle crystals. At the surfaces of these large needle crystals, there are transformed small columnar crystals $\delta_1$. This steel plate surface is superior in sliding performance compared with a mainly ζ-phase surface, but is inferior in sliding performance compared with a mainly $\delta_1$ columnar crystal surface directly formed in the 490 to 650° C. temperature region, so is not desirable.

Further, in the process of ending the alloying reaction of the steel plate in the middle of the alloying facility or in the soaking zone at its exit, conventionally the steel plate had been air cooled, but the cooling rate is slow, so if the alloy layer surface is cooled after transforming to the $\delta_1$-phase, the bottom of the alloy layer transforms to the Γ-phase and the adhesion between the alloy layer and steel plate ends up deteriorating. Conversely, if the steel plate is cooled early so that the bottom of the alloy layer does not transform much to the Γ-phase, nonalloying defects of the surface occur and an optimum mainly $\delta_1$-phase alloy layer cannot be obtained.

To solve the above-mentioned problem, as technology for suppressing the formation of the ζ-phase at the alloy layer surface and the formation of the Γ-phase at the interface of the alloy layer and steel plate, the method of using an induction heating furnace etc. as the alloying furnace (that is, heating zone) of the alloying facility to raise the heating rate, the method of raising the cooling rate after soaking, the method of suitably controlling the plating deposition, the method of suitably controlling the Al concentration in the plating bath and in the plating layer, etc. have been researched.

For example, Japanese Patent No. 3,400,289 discloses, as an example of the optimum conditions to be applied to a conventional known alloying facility provided with a fixed type soaking zone and a fixed type cooling zone, the conditions of heating the steel plate by a 30° C./sec or higher heating rate, holding it at 470 to 510° C., and cooling it by a cooling rate of 30° C./sec or more until 420° C. or less. Further, Japanese Patent No. 2,848,074 discloses technology of an alloying facility able to switch between a movable type soaking zone and a movable type cooling zone and change a heat pattern. Furthermore, Japanese Patent Publication (A) No. 5-156419 discloses technology of an alloying facility provided with a furnace designed to switch between soaking and cooling. Further, Japanese Patent Publication (A) No. 63-121644 discloses technology of an alloying facility provided with a furnace designed to perform soaking by a heating gas and cooling by a cooling gas in the same region. Furthermore, Japanese Patent Publication (A) No. 2-122058 discloses technology of an alloying facility provided with a soaking region having feed ports of heating gas at the entry side of the steel plate and performing cooling as well in this soaking region. Specifically, this soaking region is divided into a plurality of zones, exhaust ducts for exhausting the atmosphere in a zone is set at the boundary of the zones, a cooling device is set in each zone, and soaking and cooling are selectively performed in each zone.

DISCLOSURE OF THE INVENTION

However, in an actual production process, the optimum soaking temperature and soaking time constantly fluctuate due to the production specifications and other external factors, so in a conventional known alloying facility provided with a fixed type soaking zone and fixed type cooling zone using the production conditions described in Japanese Patent No. 3,400,289, it is difficult to start the cooling at the optimum point where the alloying reaction should be ended and it is difficult to substantially maintain the optimum production conditions.

On the other hand, in the case of an alloying facility provided with a movable type soaking zone and a movable type cooling zone described in Japanese Patent No. 2,848,074, it is possible to make the soaking zone and cooling zone move in accordance with the fluctuating optimum production conditions, but time is required for switching a soaking furnace and cooling furnace, so this greatly restricts production schedules and therefore operation is difficult.

Further, Japanese Patent Publication (A) No. 5-156419 discloses an alloying facility provided with a furnace enabling switching between soaking and cooling. Details of the configuration and functions etc. however are not described at all. Regarding the response when switching between soaking and cooling, time is required in the same way as Japanese Patent No. 2,848,074 and the operation is believed difficult.

Further, Japanese Patent Publication (A) No. 63-121644 discloses a furnace in which the soaking by a heating gas and the cooling by a cooling gas are performed in the same region, but for example when performing soaking by a heating gas, then cooling by a cooling gas, since there are no means for exhausting the heating gas, the heating gas and the cooling gas are mixed in the region and sufficient cooling becomes difficult. Note that Japanese Patent Publication (A) No. 63-121644 describes alternately arranging electric induction heating and gas cooling devices in this soaking and cooling region so as to achieve the functions of soaking and cooling, but there is no description at all on details of the configuration etc. It is believed that time would be required for response when switching between soaking and cooling and that operation would be difficult.

Furthermore, Japanese Patent Publication (A) No. 2-122058 discloses a furnace having a plurality of zones designed for selective soaking and cooling, but the feed port of the heating gas for the soaking is provided only at the entry side of the soaking region, that is, only one is provided for a plurality of zones, so sufficient soaking in the soaking zone is difficult. Further, since the feed port of the heating gas is provided at the entry side of the soaking region, it is not possible to cool the steel plate, then soak it. Furthermore, if cooling the steel plate at each zone, then soaking it, time would be taken for changing the atmosphere in the zone, the response would be poor, and operation would become difficult. Further, the zone length can only be changed in block length units, so the flexibility of the zone length is low. Further, zone separation members are set between the zones, so the heating gas for the soaking is blocked by the zone separation members and the heat insulating property falls.

The present invention, in consideration of the above problem, has as its object to provide a production facility and production process enabling the production of hot dip galvannealed steel plate by production conditions optimal at all times despite rapid changes in the steel type, plating deposition, and other external factors and enabling the easier production of high quality hot dip galvannealed steel plate superior in sliding performance and adhesion compared with the past.

To achieve said object, the inventors engaged in broad research on the hot dip galvannealing mechanism and galvannealing facility and their operations. From this, they obtained the following discoveries.

The main factors given as production specifications and forming the external factors changing the alloying conditions are the a) plating deposition, b) steel type (matrix composition), c) plating bath composition, d) etc. First, regarding the "a) plating deposition", when the plating deposition is large, it is necessary to increase the soaking time for making the Fe diffuse in the galvanized layer or to raise the soaking temperature causing diffusion. When the plating deposition is small, the opposite occurs.

Next, regarding the "b) steel type (matrix composition)" and "c) plating bath composition", when the matrix composition contains large amounts of C, P, Mn, etc, or when the plating bath composition contains a large amount of Al, the diffusion of the Fe in the galvanized layer becomes slow, so it is necessary to increase the soaking time for making the Fe diffuse in the galvanized layer or to raise the soaking temperature causing diffusion. The opposite is true when the amounts of the C, P, Mn, Al, and other components is small. Further, depending on the steel type, by making a suitable amount of Fe outburst into the alloy layer by the initial heating, then immediately cooling to prevent excess Fe from outbursting and causing poor appearance and holding the plate at a suitable temperature, it is possible to form a mainly $\delta_1$-phase alloy layer.

Said "a) plating deposition" and "b) steel type (matrix composition)" sometimes must be changed rapidly by large amounts in the middle of the line depending on changes in the product specifications. In this case, unless switching with a good response, a large drop in yield will occur. However, the "c) plating bath composition" is almost never rapidly changed in the middle of production.

As said "d) etc.", for example, a plated steel plate production line is connected with an annealing line etc., the case may be mentioned where the production conditions (in particular the line speed) are changed without any regard as to said "a) plating deposition", "b) steel type (matrix composition)", and "c) plating bath composition".

To adjust the diffusion of Fe in the galvanized layer, the method of adjusting the soaking temperature or the soaking time may be considered. First, adjusting the diffusion at the soaking temperature is broadly performed using a high response heating furnace. However, if the soaking temperature is high, defects in appearance sometimes occur. At a low temperature, a $\zeta$-phase sometimes ends up forming, so sometimes this cannot be suitably handled. For adjusting the diffusion by the soaking time, the method of adjusting the line speed and the method of changing the length of the soaking furnace may be considered. At this time, in the method of adjusting the line speed, the production volume is affected or speed limits due to other factors in the production facility are exceeded, so the range of adjustment by this is narrow. As the method for changing the length of the soaking furnace, there is the proposal of Japanese Patent No. 2,848,074, but as already explained, the method is poor in response and inefficient.

In view of the above, according to the present invention, there is provided a production facility of hot dip galvannealed steel plate dipping steel plate in a plating bath, then alloying it, said production facility of hot dip galvannealed steel plate having a rapid heating furnace set above plating bath tank and having a heating capability of a 30° C./sec or higher heating rate and a 500° C. or higher peak temperature and a soaking/cooling furnace set above said rapid heating furnace and treating the steel plate leaving said rapid heating furnace by at least one of soaking and cooling, said soaking/cooling furnace being comprised of a soaking region having soaking means for soaking the steel plate to 500° C. to 650° C. and a cooling region having cooling means for cooling the steel plate by a 5° C./sec or more average cooling rate, a ratio of lengths of the two regions in the furnace being freely settable, and a layout of said soaking region and cooling region being freely settable.

According to the present invention, the hot dip galvannealed steel plate production facility has a soaking/cooling furnace which can be freely set as to the ratio of the soaking region and cooling region in the furnace and can be freely set as to the layout of the soaking region and cooling region, so it is possible to set the soaking region for soaking the steel plate in the furnace and the cooling region for cooling the steel plate and set the layout of the soaking region and cooling region. In particular, when producing hot dip galvannealed steel plate, it is possible to handle rapid changes in the steel type, plating deposition, and other external factors by suitably setting the regions of the soaking zone for soaking the heated steel plate and the cooling zone for cooling it and the layout of the soaking region and cooling region and, for example, cooling the steel plate after soaking or conversely soaking after cooling, so it is possible to produce hot dip galvannealed steel plate by the optimum production conditions at all times.

In the production facility of said hot dip galvannealed steel plate, at least one pair of said soaking means arranged facing the two surfaces of the running steel plate in said soaking/cooling furnace and at least one pair of said cooling means arranged facing the two surfaces of the running steel plate may be alternately arranged along the line direction of the steel plate.

In the production facility of said hot dip galvannealed steel plate, said cooling means may be cooling means spraying cooling medium from spray nozzles to the steel plate.

In the production facility of said hot dip galvannealed steel plate, said spray nozzles may be configured with ejection ports able to rotate about an axis parallel to a width direction of the steel plate and said spray nozzles at the boundary of said soaking region and said cooling region can spray cooling gas vertical to the steel plate and form a barrier to the flow of gas.

In the production facility of said hot dip galvannealed steel plate, said soaking means may also have blower devices for heating the steel plate by hot air.

In the production facility of said hot dip galvannealed steel plate, said soaking means may also have exhaust devices at the downstream side of said blower devices.

In the production facility of said hot dip galvannealed steel plate, said soaking means may be radiant heating devices for radiant heating of steel plate.

In the production facility of said hot dip galvannealed steel plate, exhaust ports may be provided in said soaking/cooling furnace at a top of said soaking/cooling furnace and/or at locations able to become a boundary between said soaking region and said cooling region.

In the production facility of said hot dip galvannealed steel plate, an exclusive soaking furnace for soaking the steel plate at 500° C. to 650° C. may be arranged between said rapid heating furnace and said soaking/cooling furnace.

According to the present invention in another aspect, there is provided a process of production of hot dip galvannealed steel plate comprising using said production facility to dip steel plate in a plating bath, then alloying it.

BEST MODE FOR CARRYING OUT THE INVENTION

Figure 1:
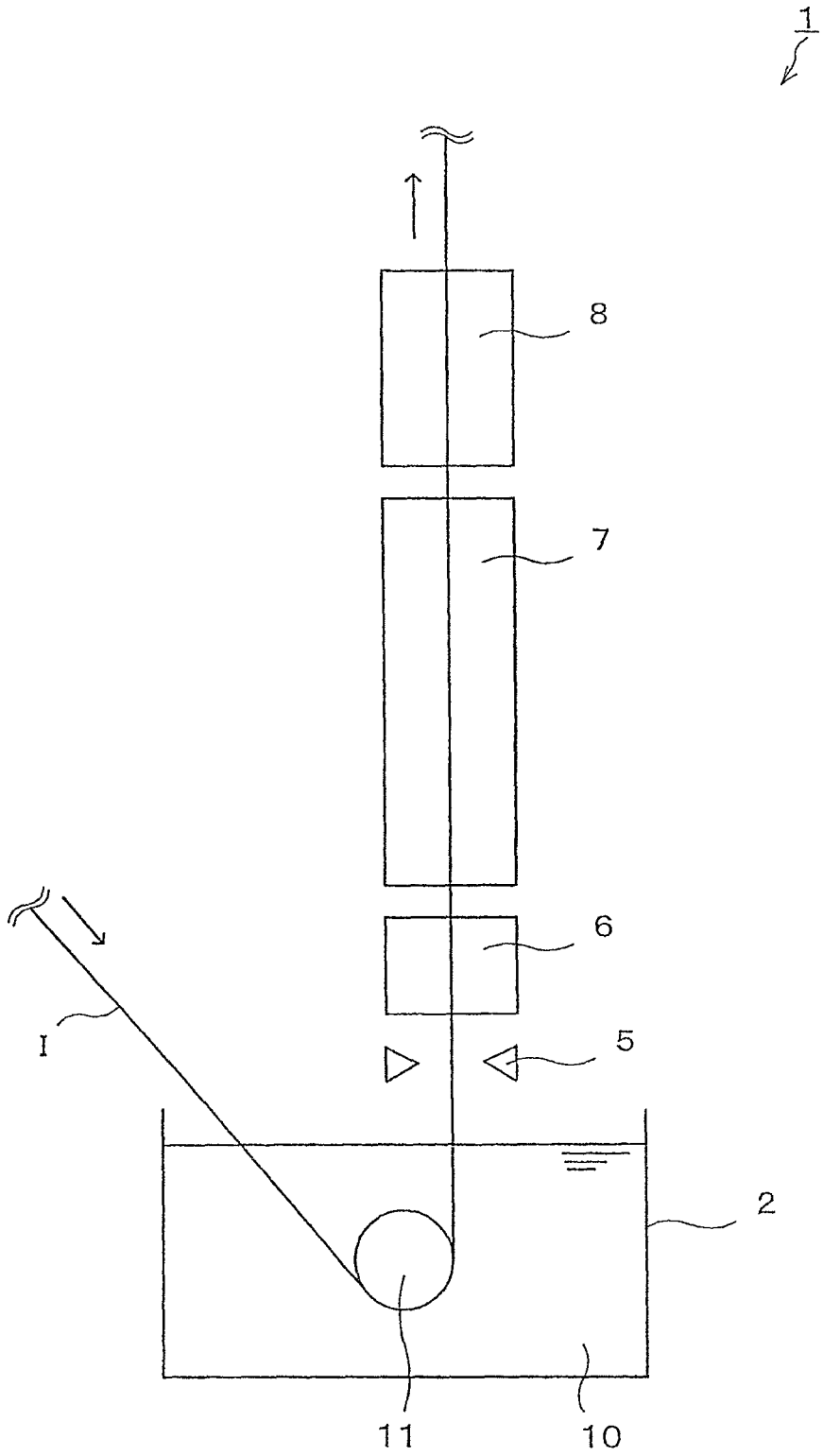
FIG. 1 is a view of the configuration of a production facility 1 of a hot dip galvannealed steel plate according to an embodiment of the present invention.

Below, preferred embodiments of the present invention will be explained while referring to the drawings. Note that in the description and the drawings, elements having substantially the same functions and configurations are assigned the same reference notations and therefore overlapping explanations are omitted.

FIG. 1 is a view of the configuration of a production facility 1 of hot dip galvannealed steel plate according to an embodiment of the present invention. As shown in FIG. 1, the production facility 1 is configured having, in upward order from the bottom, the plating bath tank 2, gas wiping nozzles 5, a rapid heating furnace 6, a soaking/cooling furnace 7, and a cooling furnace 8. The plating bath tank 2 is filled with, as a plating bath 10, a 440 to 480° C. hot dip galvanization solution etc. The production facility 1, as shown by the arrows in FIG. 1, makes the steel plate I advance into the plating bath tank 2 from the top to bottom by a predetermined inclination angle to immerse it in the plating bath 10, then makes the steel plate I advance upward in the vertical direction (that is, the line direction) guided by the support roll 11 provided inside the plating bath tank 2 so as to make the steel plate I leave the plating bath 10 and then runs it through the gas wiping nozzles 5, rapid heating furnace 6, soaking/cooling furnace 7, and cooling furnace 8 in that order to alloy the sheet I.

The gas wiping nozzles 5 are arranged facing the two surfaces of the steel plate I running after leaving the plating bath 10 and spray gas on the two surfaces of the steel plate I so as to adjust the amounts of deposition of plating on the surfaces of the steel plate I.

The rapid heating furnace 6 is comprised of an induction heating furnace and/or burner heating furnace. In the present embodiment, the rapid heating furnace 6 has a heating capability able to heat the steel plate I by a 30° C. or more/sec heating rate and make the steel plate I reach a 500° C. or higher peak temperature.

The cooling furnace 8 is provided inside the furnace with a plurality of nozzles (not shown) arranged facing the two surfaces of the steel plate I along the line direction of the steel plate I and sprays cooling air from these nozzles on the steel plate I leaving the soaking/cooling furnace 7 so as to cool the steel plate I. Note that what is sprayed from the nozzle may be a mist or fog etc. in addition to cooling air.

Figure 2:
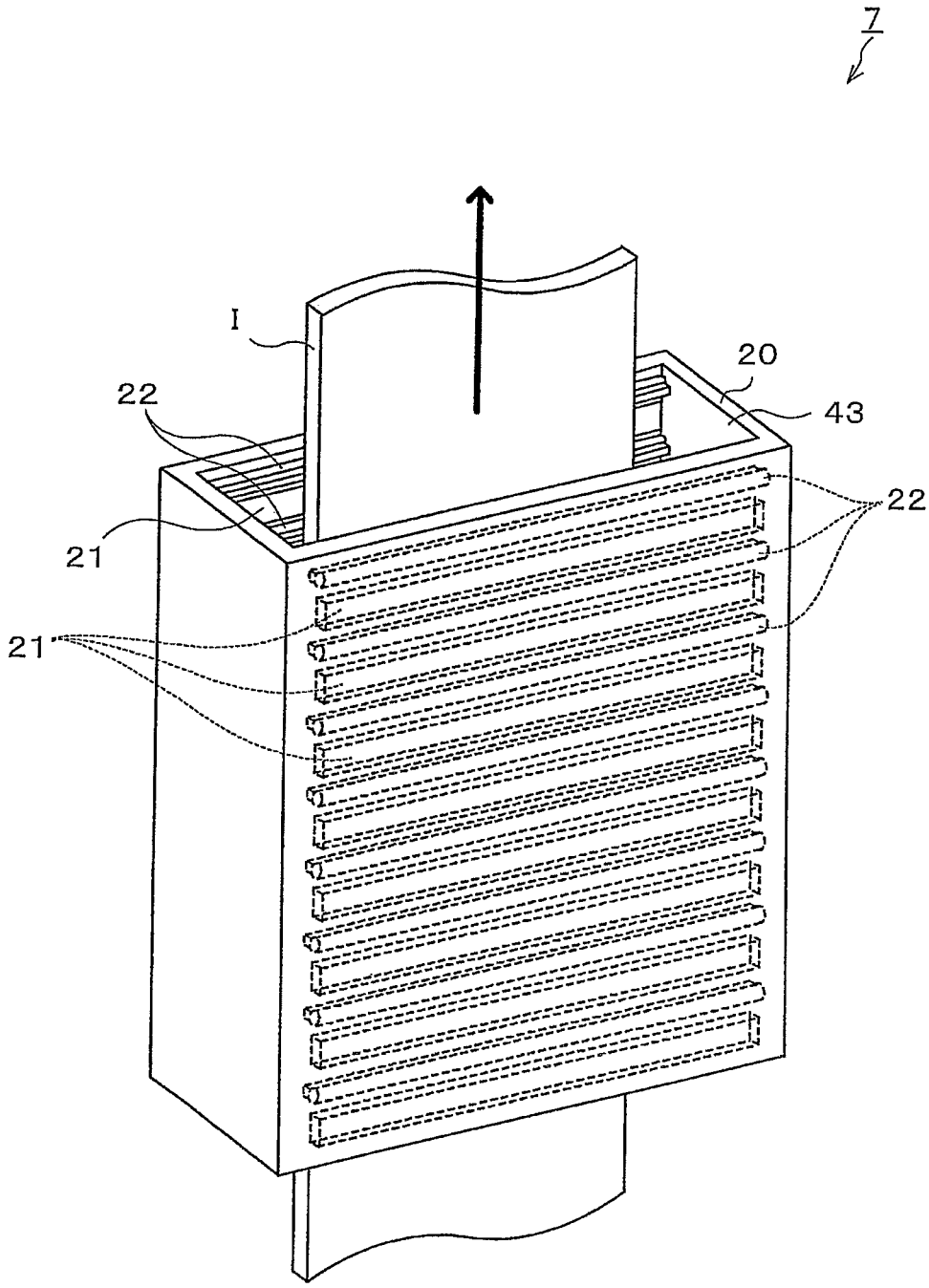
FIG. 2 is a perspective view of a soaking/cooling furnace 7.
Figure 3:
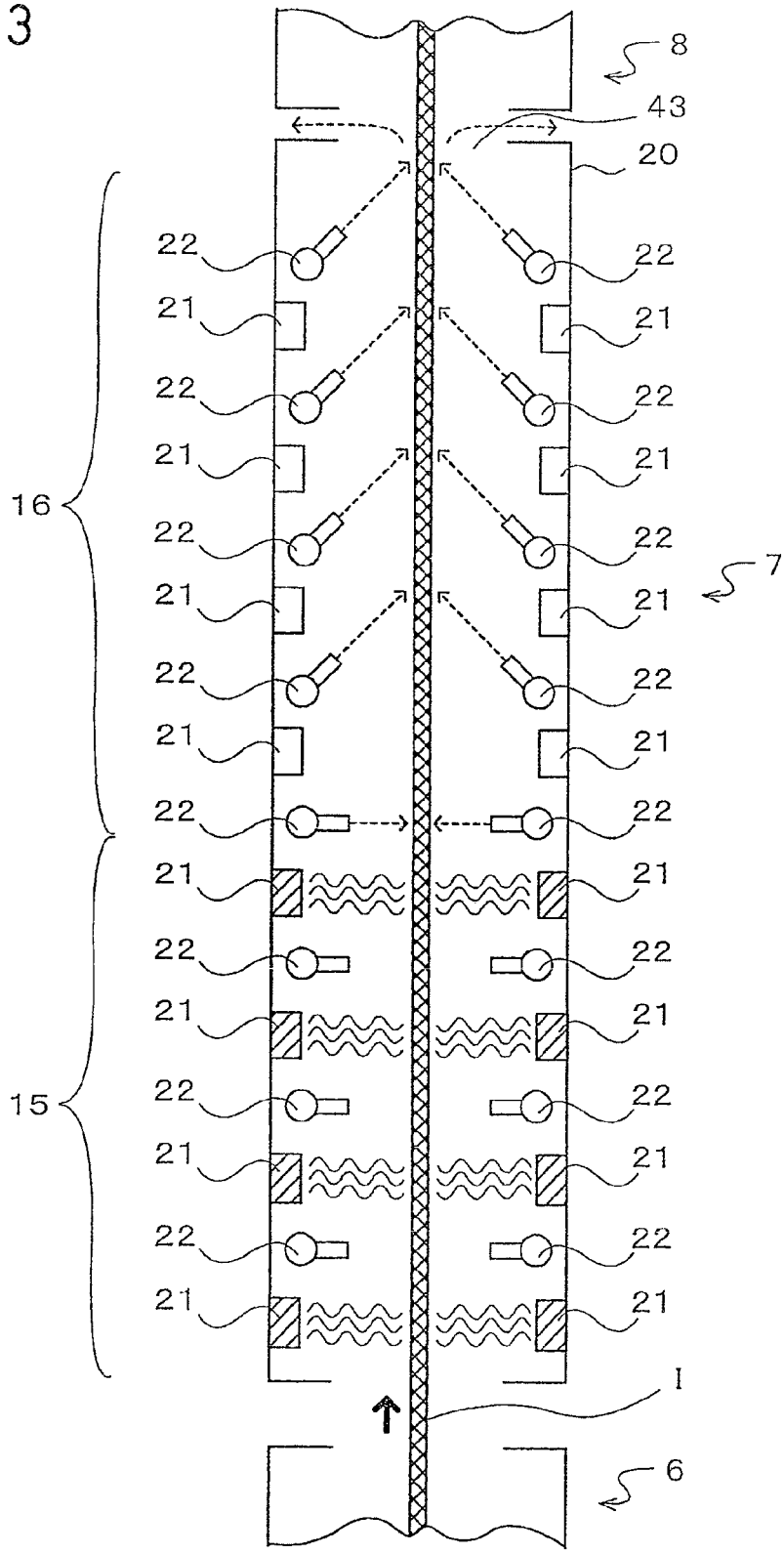
FIG. 3 is a cross-sectional schematic view from the side of a soaking/cooling furnace 7 in the case where the soaking/cooling furnace 7 is provided with both a soaking region 15 and a cooling region 16.

FIG. 2 is a perspective view of a soaking/cooling furnace 7. FIG. 3 is a cross-sectional view from the side of a soaking/cooling furnace 7.

The soaking/cooling furnace 7, as shown in FIG. 2, is configured so that the steel plate I runs upward in the vertical direction inside the box shaped body 20 provided with open top and bottom surfaces. Inside the body 20, as shown in FIG. 3, eight pairs of soaking means 21 are provided along the line direction arranged facing the two surfaces of the running steel plate I and able to radiantly heat the steel plate I from the two surfaces. Further, inside the body 20, eight pairs of spray nozzles 22 are provided along the line direction arranged facing the two surfaces of the running steel plate I and able to spray the cooling gas on the two surfaces of the steel plate I. At their downstream side, exhaust ports 43 exhausting the atmosphere in the main body 20 are formed at the top of the main body 20. In the present embodiment, the pairs of soaking means 21 and the pairs of spray nozzle 22 are alternately arranged at predetermined intervals along the line direction. Further, in the present embodiment, electric heaters are used as the soaking means 21, while flat nozzles are used as the spray nozzles 22.

The soaking means 21 can be individually controlled in soaking operation for each facing pair. Due to this, it is possible to individually operate or stop each pair of soaking means 21 to switch the soaking state for heating and soaking the steel plate I and the stopped state for stopping the heating of the steel plate I.

The spray nozzles 22 are configured to be able to be adjusted in the spraying directions when spraying the cooling gas by making the ejection ports rotate about an axis parallel to the width direction of the steel plate I. Due to this, it is possible to set the spraying directions of the spray nozzles 22 to be vertical to the surfaces of the steel plate I (that is, the spraying directions in the horizontal direction) or to set them to be slanted with respect to the surfaces of the steel plate I (that is, the spraying directions to be slanted with respect to the horizontal direction). The spray nozzles 22 can be individually controlled in the spraying operation of the cooling gas for each facing pair. Due to this, it is possible to individually set the spraying directions of the pairs of spray nozzles 22 and furthermore individually operate or stop the pairs to switch the spraying state when spraying cooling gas to the steel plate I and the stopped state when stopping the spraying of the spray nozzles 22.

The soaking/cooling furnace 7 is configured to enable a change of the ratio of the soaking region 15 for soaking the steel plate I at the rapid heating furnace 6 side (that is, the entry side of the steel plate I) and the cooling region 16 for cooling the steel plate at the cooling furnace 8 side (that is, the exit side of the steel plate I) in accordance with the steel type, plating deposition, line speed, and other alloying conditions of the steel plate I being alloyed. The soaking region 15 is set by operating the soaking means 21 continuing along the line direction from the entry side of the soaking/cooling furnace 7 and setting them in the soaking state and by stopping all spray nozzles 22 upstream of the soaking means 21 set in the soaking state (that is, downward in the vertical direction) and setting them in the stopped state. As opposed to this, the cooling region 16 is set by stopping all of the remaining soaking means 21 to set them in the stopped state and by operating all of the remaining spray nozzles 22 to set them in the spraying state.

The soaking/cooling furnace 7 having the above configuration is configured to be able to soak the steel plate I being run through the soaking region 15 by a soaking temperature of 500° C. or more and cool the steel plate I being run through the cooling region 16 by a 5° C./sec or more average cooling rate.

The method of production of hot dip galvannealed steel plate using a production facility 1 according to an embodiment of the present invention configured in the above way will be explained using FIG. 1 to FIG. 3.

First, as shown in FIG. 1, the steel plate I of the steel type A is run in the arrow direction by the line speed B, is dipped in the plating bath 10 in the plating bath tank 2, then is made to advance upward in the vertical direction and leave the plating bath 10. The steel plate I leaving the plating bath 10 is made to advance into the processing region of the gas wiping nozzles 5, gas is blown at the two surfaces of the steel plate I, and plating metal deposited on the surfaces of the steel plate I is blown off to adjust the plating deposition of the steel plate I to C.

Next, the steel plate I is made to leave the processing region of the gas wiping nozzles 5 and made to advance into the rapid heating furnace 6. Further, while running the steel plate I inside the rapid heating furnace 6, the steel plate I is heated by a heating rate of 30° C./sec or more to make the steel plate I reach 500° C. or more, preferably 650° C. or less, as a peak temperature.

After this, when the steel plate I reaches a predetermined temperature in the rapid heating furnace 6, the steel plate I is made to leave the rapid heating furnace 6 and advance into the soaking/cooling furnace 7. Note that the soaking/cooling furnace 7 is preset to the optimum ratio of the soaking region 15 and cooling region 16 based on the steel type, line speed, plating deposition, and other production conditions of the steel plate I. For example, the case, when producing hot dip galvanized steel plate under the production conditions of a steel plate I of a steel type A, a line speed of B, and a plating deposition of C, as shown in FIG. 3, it is suitable to soak the steel plate I at the lower side (upstream side) of the soaking/cooling furnace 7 and cool the steel plate I at the upper side (downstream side) of the soaking/cooling furnace 7 will be explained in detail.

In this case, the four pairs of soaking means 21 at the lower (upstream side) soaking region 15 in the soaking/cooling furnace 7 are set at the soaking state (in FIG. 3, soaking state shown by hatched lines), while the four pairs of soaking means 21 at the upper (downstream side) cooling region 16 are set to the stopped state. Further, the five pairs of spray nozzles 22 at the upper (downstream side) cooling region 16 in the soaking/cooling furnace 7 are set in the spraying state (in FIG. 3, spraying state shown by broken line arrows), while the three pairs of spray nozzles 22 at the lower (upstream side) soaking region 15 are set to the stopped state.

As explained above, inside the soaking/cooling furnace 7 set in the ratio of the soaking region 15 and cooling region 16, while the steel plate I is advancing through the soaking region 15 while making it run at the line speed B, four pairs of soaking means 21 are used to radiantly heat the steel plate I and soak it at a soaking temperature of 500° C. to 650° C. Next, the steel plate I is advanced from the soaking region 15 to the cooling region 16. While the steel plate I is advancing through the cooling region 16, the pairs of spray nozzle 22 spray cooling gas toward the steel plate I to cool it by a 5° C./sec or higher average cooling rate while making it run by the line speed B.

Further, the plate was made to leave the soaking/cooling furnace 7 and advance into the cooling furnace 8. In the cooling furnace 8, the steel plate I is made to run at the line speed B and nozzles (not shown) are used to spray cooling air, mist, or fog to cool the steel plate I. By the above series of alloying treatments, hot dip galvannealed steel plate having the optimum alloy layer is produced from steel plate I of the steel type A.

Note that as shown in FIG. 3, when the soaking/cooling furnace 7 is set to have both a soaking region 15 and a cooling region 16, among all of the pairs of spray nozzles 22 forming the cooling region 16, the pair of spray nozzles 22 most at the soaking region 15 in the line direction (that is, at the boundary of the soaking region 15 and cooling region 16) are set so that their spraying directions become vertical to the surfaces of the steel plate I (that is, so as to be parallel to the horizontal direction). Due to this, at the boundary of the soaking region 15 and cooling region 16, the cooling gas sprayed from the spray nozzles 22 forms a wall of gas between the soaking region 15 and cooling region 16 like an air curtain to prevent the heated atmosphere at the soaking region 15 side from entering the cooling region 16. On the other hand, the remaining pairs of spray nozzles 22 forming the cooling region 16 are set so that their spraying directions face the surfaces of the steel plate I in the line direction (that is, vertical direction) (that is, so as to be slanted upward with respect to the horizontal direction). Due to this, the atmosphere (including cooling gas) of the cooling region 16 proceeds along the line direction of the steel plate I, a flow exiting to the outside from between the exhaust ports 43 of the soaking/cooling furnace 7 and cooling furnace 8 is formed, and the internal pressure is maintained constant. Note that the exhaust ports 43 may be formed at least at the top of the soaking/cooling furnace 7 or locations able to form the boundary between the soaking region 15 and cooling region 16 so as to maintain a predetermined internal pressure.

In the above, the layout of the soaking region 15 and cooling region 16 in the soaking/cooling furnace 7 was explained for the case of the steel plate I being soaked, then cooled, but depending on the steel type, sometimes it is best to heat, then immediately cool, then soak the steel plate to form a mainly $\delta_1$-phase galvanized layer (not shown). In this case, for example, the lower side (upstream side) of the soaking/cooling furnace 7 uses spray nozzles 22 to cool the steel plate, while the upper side (downstream side) uses the soaking means 21 to soak the steel plate I.

Figure 4:
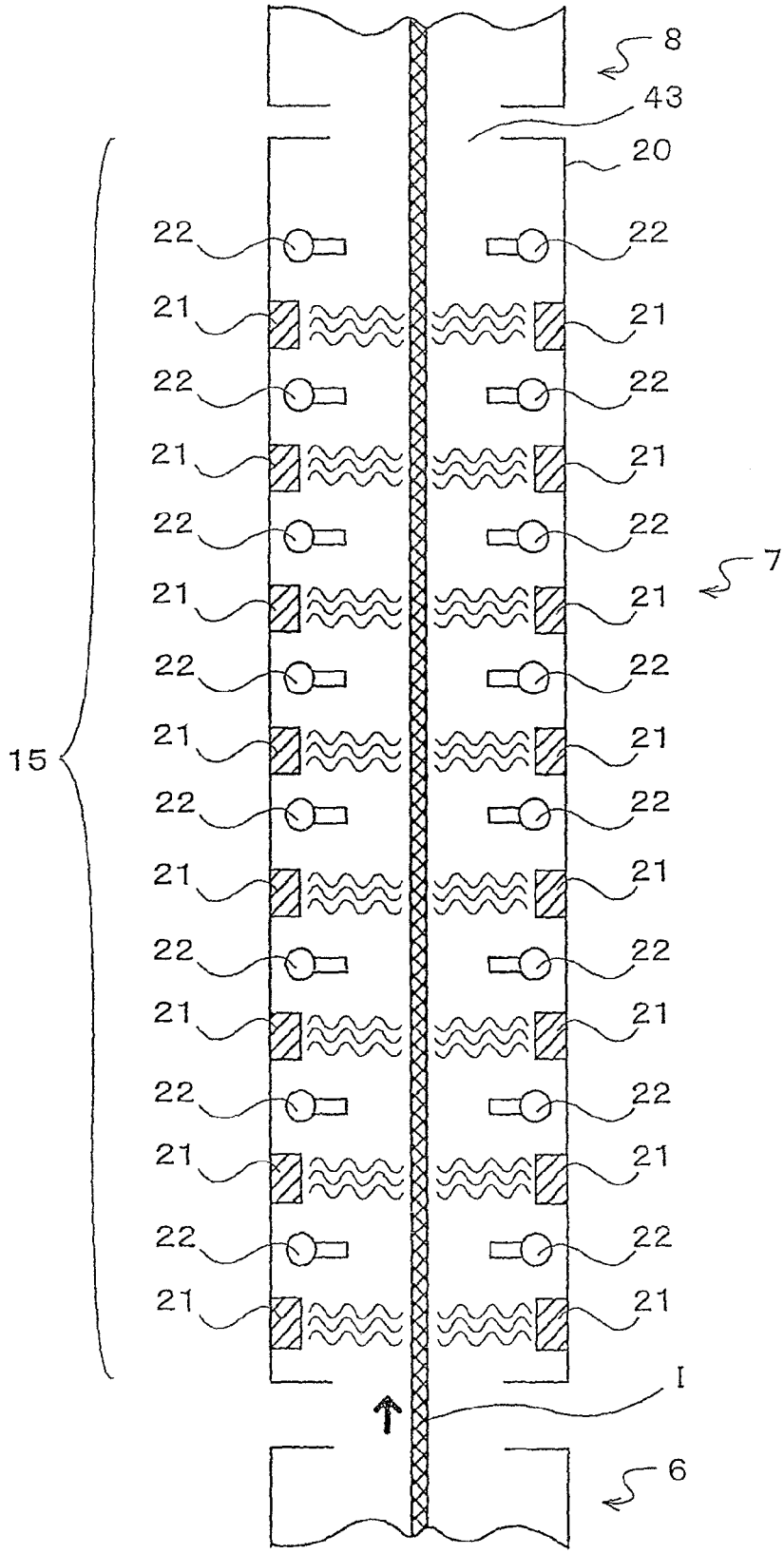
FIG. 4 is a cross-sectional schematic view from the side of a soaking/cooling furnace 7 in the case where the soaking/cooling furnace 7 is provided with just a soaking region 15 and is not provided with a cooling region 16.

In the above, the soaking/cooling furnace 7 was explained with reference to the case where the soaking/cooling furnace 7 had both a soaking region 15 and a cooling region 16, but it is also possible to provide just one of the soaking region 15 or cooling region 16. FIG. 4 is a cross-sectional schematic view from the side of a soaking/cooling furnace 7 set to have just a soaking region 15 based on the steel type D, line speed E, and plating deposition F. In this case, as shown in FIG. 4, all of the soaking means 21 of the soaking/cooling furnace 7 are set to the soaking state and all of the spray nozzles 22 are set to the stopped state.

According to the above first embodiment, when producing hot dip galvannealed steel plate from steel plate I, the ratio of the soaking region 15 and cooling region 16 in the soaking/cooling furnace 7 is changed and the soaking process and cooling process in the alloying is optimally set in accordance with the production conditions based on the steel type, line speed, plating deposition, and other production conditions of the steel plate I, so it is possible to reduce the $\zeta$-phase and $\Gamma$-phase without causing nonalloying defects and to suitably produce high quality hot dip galvannealed steel plate mainly comprised of the $\delta_1$-phase. Furthermore, by individually controlling the soaking means 21 and spray nozzles 22 arranged alternately along the line direction in the soaking/cooling furnace 7 and switching the ratio of the soaking region 15 and cooling region 16 in the soaking/cooling furnace 7, the switching response becomes higher, the switching of the ratio of the soaking region 15 and cooling region 16 in accordance with the production conditions ends in a shorter time than the past, and production of hot dip galvannealed steel plate can be immediately started, so operation becomes extremely easy.

Furthermore, as shown in FIG. 3, among the pairs of spray nozzles 22 forming the cooling region 16, the pair of spray nozzles 22 most at the soaking region 15 side in the line direction are set so that their spraying directions of cooling gas become vertical to the surfaces of the steel plate I, whereby when the soaking/cooling furnace 7 has both a soaking region 15 and cooling region 16, the cooling gas sprayed from the pair of spray nozzles 22 most at the soaking region 15 side forms a wall of a flow of gas by the same principle as an air curtain between the soaking region 15 and cooling region 16, temperature interference between the soaking region 15 and cooling region 16 is reduced, and the soaking effect and cooling effect can be raised. Furthermore, in the cooling region 16, the atmosphere (including cooling gas) proceeds along the line direction of the steel plate I and forms a flow exiting to the outside from between the soaking/cooling furnace 7 and cooling furnace 8, so cooling gas cooling the steel plate I and raised in temperature is driven out and the steel plate I is constantly cooled by low temperature cooling gas.

Figure 5:
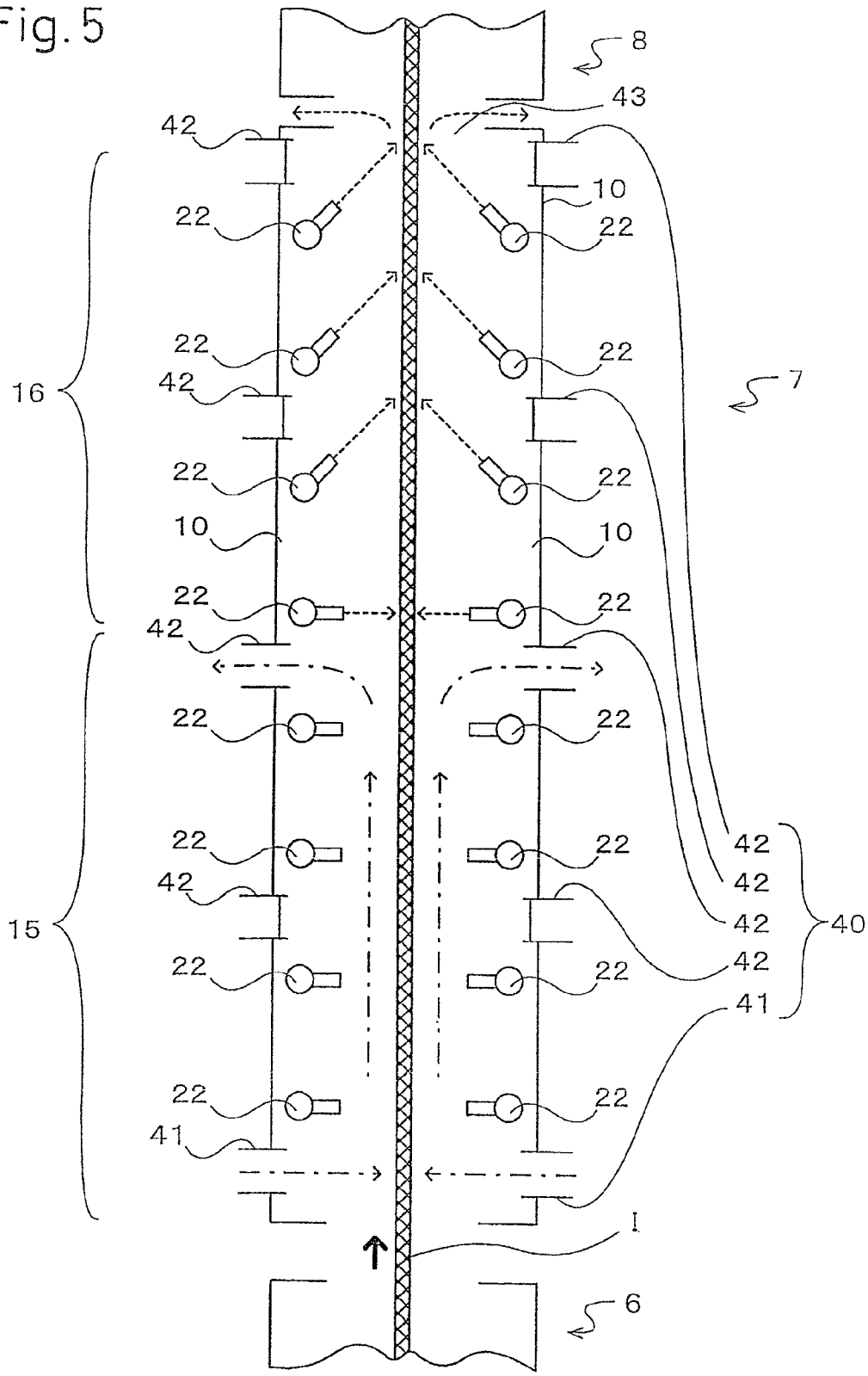
FIG. 5 is a cross-sectional schematic view from the side of the overall configuration of a soaking/cooling furnace 7 provided in a production facility 1 of a hot dip galvannealed steel plate according to a second embodiment of the present invention.

Next, the soaking/cooling furnace 7 may also have a soaking means 40 for heating the steel plate I by hot air. FIG. 5 is a cross-sectional schematic view from the side showing the overall configuration of the soaking/cooling furnace 7 provided in a production facility 1 of hot dip galvannealed steel plate of a second embodiment of the present invention employing this configuration.

As shown in FIG. 5, in the second embodiment, at the entry side in the main body 20 of the soaking/cooling furnace 7, one pair of blower devices 41 arranged facing the two surfaces of the running steel plate I and able to heat the steel plate from the two surfaces by hot air by blowing hot air into the main body 20 is provided. Downstream of this one pair of blower devices 41 (that is, upward in the vertical direction), like in the first embodiment, eight pairs of spray nozzles 22 arranged facing the two surfaces of the steel plate I and able to spray cooling gas to the two surfaces of the steel plate I are provided along the line direction. Exhaust ports 43 are arranged at their downstream side. Further, in the main body 20, four pairs of exhaust devices 42 arranged facing the two surfaces of the steel plate I and able to exhaust the atmosphere in the main body 20 are arranged along the line direction. In the second embodiment, two pairs of spray nozzles 22 and one pair of exhaust devices 42 are alternately arranged at predetermined intervals along the line direction.

The soaking means 40 of the soaking/cooling furnace 7 has the above one pair of blower devices 41 and four pairs of exhaust devices 42. In the second embodiment, exhaust devices 42 able to open and close are used. The blower devices 41 and exhaust devices 42 of the soaking means 40 can be independently controlled in operation for each facing pair. For example, when the soaking/cooling furnace 7 is set to have a soaking region 15, the blower devices 41 are operated to set them in a blowing state, while when it is set not to have a soaking region 15, the blower devices 41 can be stopped to set them in the stopped state. Further, when the soaking/cooling furnace 7 is set to have a soaking region 15, the pairs of the exhaust devices 42 can be individually opened/closed to switch between the exhaust state of exhausting the atmosphere in the main body 20 and the closed state of not exhausting it.

In the second embodiment, when the soaking/cooling furnace 7 is set to have a soaking region 15, the pair of exhaust devices 42 at the downstream-most part from the soaking region 15 (that is, upward in the vertical direction) are opened to set them in the exhaust state and the remaining pairs of the exhaust device 42 are all closed to set them in the closed state. Due to this, as shown by dot-chain line in FIG. 5, the hot air blown from the blower devices 41 in the blowing state soaks the steel plate I, proceeds through the soaking region 15 in the main body 20 along the line direction, and exits from the exhaust state exhaust devices 42.

According to the above second embodiment, by cooling the steel plate I running through the cooling region 16 in the soaking/cooling furnace 7 by the cooling gas and also soaking the steel plate I running through the soaking region 15 by hot air, when switching the ratio from the soaking region 15 to the cooling region 16, it is possible to immediately switch the atmosphere in the main body 20. The response in switching becomes further higher. Due to this, the switching of the ratio of the soaking region 15 and cooling region 16 according to the production conditions is completed in a further shorter time and operation is further simplified.

Furthermore, by arranging the exhaust devices 42 of the soaking means 40 at a location able to form a boundary between the soaking region 15 and cooling region 16, it is possible to exhaust the heated atmosphere at the soaking region 15 side to the outside without allowing it to advance into the cooling region 16, the temperature interference between the soaking region 15 and cooling region 16 is reduced, and the soaking effect and cooling effect can be enhanced. In particular, as explained in the first embodiment, when the spray nozzles 22 at the boundary between the soaking region 15 and cooling region 16 spray cooling gas vertical to the surfaces of the steel plate I to make it function as an air curtain, it is possible to further reduce the temperature interference between the soaking region 15 and cooling region 16 and raise the soaking effect and cooling effect more. Note that the second embodiment gives the similar other effects as obtained in the first embodiment. In FIG. 5, the blower devices 41 are set at the upstream-most side of the main body (that is, down in the vertical direction) and are arranged for cooling the plate after soaking. It is not possible to change the arrangement for each steel type, but by adding the blower devices 41 at the center of the main body 20 or changing the position of arrangement of the blower devices 41 to the center of the main body 20, it is also possible to arrange the devices to cool, then soak the steel plate.

Above, preferred embodiments of the present invention were explained with reference to the attached drawings, but the present invention is not limited to these examples. A person skilled in the art clearly could conceive of various modifications or changes in the scope of the technical concept described in the claims. It is understood that these naturally also fall in the technical scope of the present invention.

In the above first embodiment, the case where the soaking/cooling furnace 7 has eight pairs of soaking means 21 and spray nozzles 22 arranged facing the two surfaces of the steel plate I was explained, but the soaking means 21 and spray nozzle 22 may be of any number.

In the above first embodiment, the case where the soaking/cooling furnace 7 has one pair of spray nozzles 22 and one pair of soaking means 21 alternately arranged along the line direction was explained, but any number of pairs of soaking means 21 and any number of pairs of spray nozzle 22 may also be arranged alternately along the line direction. Further, at this time, it is also possible to control the pairs of spray nozzles arranged continuously along the line direction all together. In the same way, it is also possible to control the soaking means 21 arranged continuously along the line direction all together.

In the above-mentioned first and second embodiments, the explanation was given of the case as shown in FIG. 3 where the soaking/cooling furnace 7 was set to have both a soaking region 15 and cooling region 16 based on the production conditions of a steel type of A, a line speed of B, and a plating deposition of C, the case as shown in FIG. 4 where the soaking/cooling furnace 7 was set to have only a soaking region 15 based on the production conditions of a steel type of D, a line speed of E, and a plating deposition of F, and the case as shown in FIG. 5 where the soaking/cooling furnace 7 was set to have a soaking region 15 by operating the blower devices 41 to set them in the blowing state and was set to not have a soaking region 15 by stopping the blower devices 41 to set them in the stopped state, but the soaking/cooling furnace 7 can be freely changed in setting among the three settings (1) to (3) of (1) the setting having only a soaking region 15, (2) the setting having only a cooling region 16, and (3) the setting having both a soaking region 15 and cooling region 16. Further, at that time, the ratio of the soaking region 15 and cooling region 16 and the layout of the soaking region 15 and cooling region 16 can be freely set.

In the above-mentioned first and second embodiments, the production facility 1 was explained for the case where the gas wiping nozzles 5, rapid heating furnace 6, soaking/cooling furnace 7, and cooling furnace 8 were arranged in that order from the bottom above the plating bath tank 2, but the production facility 1 may be otherwise configured as well. In particular, it is also possible to arrange a dedicated soaking furnace for soaking the steel plate I at 500° C. to 650° C. between the rapid heating furnace 6 and the soaking/cooling furnace 7 and soak the steel plate I even outside the soaking/cooling furnace 7.

In the above-mentioned second embodiment, the case of one pair of blower devices 41 of the soaking means 40 of the soaking/cooling furnace 7 was explained, but any number of blower devices 41 may be provided at the soaking/cooling furnace 7. Further, the blower devices 41 may be laid out in any way as well. For example, it is also possible to arrange another pair of blower devices 41 from the pair of blower devices 41 shown in FIG. 5 above the pair of spray nozzles 22 arranged second from the bottom in the soaking/cooling furnace 7 shown in FIG. 5. When the length of the soaking/cooling furnace 7 is long, by arranging other blower devices 41, it is possible to shorten the time for switching the cooling zone to a soaking zone and raise the response.

Further, in FIG. 5, the case where two pairs of spray nozzles 22 and one pair of soaking means 40 were alternately arranged along the line direction was explained, but it is also possible to alternately arrange any number of pairs of soaking means 40 and any number of pairs of spray nozzles 22 along the line direction. Further, at this time, it is also possible to control the pairs of spray nozzles 22 arranged continuously along the line direction all together. Similarly, it is also possible to control the pairs of soaking means 40 arranged continuously along the line direction all together.

Note that the soaking means 40 may also be made a structure pairing a blower device 41 and exhaust device 42, that is, a structure in which a blower device 41 and exhaust device 42 are arranged facing each other across the steel plate I or a structure where a plurality of such pairs are provided.

In the above-mentioned second embodiment, the case of the blower devices 41 of the soaking means 40 of the soaking/cooling furnace 7 blowing hot air into the main body 20 to heat the steel plate I by hot air was explained, but when the blower devices 41 are in the cooling region 16, the blower devices 41 may also blow cooling air inside the main body 20 to cool the steel plate I by cooling air.

EXAMPLES

Examples of the present invention will be explained in comparison with comparative examples.

Example I

First, the case of using a soaking/cooling furnace for soaking, then cooling steel plate will be explained. The results of using the production facility of the present invention and the conventional type production facility to produce hot dip galvannealed steel plate from the test materials of the steel types of the compositions shown in Table 1 under various types of production conditions are shown in Table 2. Note that the length in the line direction of the soaking/cooling furnace having the production facility of the present invention was made 25 m. For the conventional type production facility, the length in the line direction of the fixed type soaking furnace was made 14.2 m, and the line in the line direction of the fixed type cooling furnace was made 10.8 m. Further, the Al concentration in the plating bath was made 0.134 mass % at both the production facility and conventional type production facility of the present invention.

TABLE 1

| | C | Si | Mn | P | S |
|---|---|---|---|---|---|
| Test Material 1 | 0.002 | 0.024 | 0.16 | 0.016 | 0.012 |
| Test Material 2 | 0.001 | 0.022 | 0.12 | 0.009 | 0.009 |

* Compositions are all mass %

Test Material 1 cannot be secured, and the alloy layer of the produced hot dip galvannealed steel plate ends up with alloying defects. Furthermore, in Comparative Example No. 8, the optimum soaking time 7 (sec) for the Test Material 1 was secured and the hot dip galvannealed steel plate having the optimum alloy layer could be produced, but the line speed was an extremely small 122 (m/min), so the production efficiency ended up dropping sharply. In this way, with just attempting to deal with changes in the plating deposition by the line speed, it sometimes becomes impossible to deal with

TABLE 2

| | No. | Steel type | Plating deposition ($g/m^2$) | Rapid heating furnace: Entry side plate temp. (° C.) | Rapid heating furnace: Heating rate (° C./sec) | Rapid heating furnace: Exit side plate temp. (° C.) | Hot idling/cooling furnace: Entry side plate temp. (° C.) | Hot idling/cooling furnace: Holding time (sec) | Hot idling/cooling furnace: cooling rate (° C./sec) | Alloy layer eval. | Line speed (m/min) | Remarks |
|---|---|---|---|---|---|---|---|---|---|---|---|---|
| Inv. ex. | 1 | Test Material 1 | 32 | 420 | 36.4 | 520 | | 4 | 12 | ○ | 142 | |
| | 2 | Test Material 1 | 46 | 420 | 36.4 | 520 | | 6 | 12 | ○ | 142 | |
| | 3 | Test Material 1 | 62 | 420 | 36.4 | 520 | | 7 | 12 | ○ | 142 | |
| | 4 | Test Material 2 | 49 | 420 | 36.4 | 520 | | 5 | 12 | ○ | 142 | |
| | 5 | Test Material 2 | 49 | 420 | 29.5 | 520 | | 5 | 12 | ○ | 115 | |
| Comp. ex. | 6 | Test Material 1 | 31 | 420 | 39.7 | 520 | | 5.5 | 12 | X | 155 | |
| | 8 | Test Material 1 | 61 | 420 | 31.2 | 520 | | 7 | 12 | ○ | 122 | |
| | 9 | Test Material 1 | 61 | 420 | 51 | 560 | | 6 | 12 | X | 142 | |
| | 10 | Test Material 1 | 31 | 420 | 23.7 | 485 | | 6 | 12 | Δ | 142 | |
| | 11 | Test Material 2 | 45 | 420 | 36.4 | 520 | | 6 | 12 | Δ | 142 | |

In the evaluation of the alloy layers in Table 2, cases where the alloy layer of the produced hot dip galvannealed steel plate is the optimal alloy layer mainly comprised of the $\delta_1$-phase are indicated by the "○" mark, cases where the ζ-phase and Γ-phase are excessive are indicated by the "Δ" mark, and cases where there are nonalloying defects are indicated by the "X" mark.

First, consider the case of changing the plating deposition among the conditions when producing hot dip galvannealed steel plate. As shown in Table 2, in Example Nos. 1 to 3 according to the present invention using the Test Material 1, when the plating deposition changed to 32 to 62 ($g/m^2$), the inventors changed the ratio of the soaking region and cooling region of the soaking/cooling furnace without changing the line speed 142 (m/min) and the heating rate of the rapid heating furnace of 36.4 (° C./sec), optimally soaked the Test Material 1, and were able to produce hot dip galvannealed steel plate having the optimum alloy layer without changing the line speed in any case. Further, they were able to handle even changes in the plating deposition without any effect on the annealing furnace and other facilities in the line.

As opposed to this, in Comparative Example Nos. 6 to 8 according to the prior art using Test Material 1, when the plating deposition changed to 31, 46, and 61 ($g/m^2$), the inventors changed the line speed to 155, 142, and 122 (m/min) to try to secure the optimum soaking time for the Test Material 1. In Comparative Example No. 7, the optimum alloy layer was obtained, but in Comparative Example No. 6, the upper limit of line speed of the facility, that is, 155 (m/min), ended up being reached, the optimum soaking time 4 (sec) for the them due to the upper limit on the line speed of the facilitie or the production efficiency is greatly affected.

Further, in Comparative Example Nos. 9 and 10 according to the prior art using the Test Material 1, when changing the plating deposition to respectively 61 and 31 ($g/m^2$), the heating rate of the rapid heating furnace was changed to 51.0 and 23.7 (° C./sec) without changing the soaking time so as to optimally soak the Test Material 1. However, in Comparative Example No. 9, the heating rate was an overly high 51.0 (° C./sec), so alloying defects ended up occurring. Further, in Comparative Example No. 10, the heating rate was an overly low 23.7 (° C./sec), so the alloy layer of the produced hot dip galvannealed steel plate ended up with an excessive ζ-phase and Γ-phase state.

Further, consider the case of changing the steel type among the conditions when producing hot dip galvannealed steel plate. As shown in Table 2, in Example No. 4 according to the present invention, hot dip galvannealed steel plate was produced by changing the steel type from the Test Material 1 to the Test Material 2. In this case as well, by adjusting the ratio of the soaking region and cooling region of the soaking/cooling furnace, it was possible to optimally soak the Test Material 2 and produce hot dip galvannealed steel plate having the optimum alloy layer.

As opposed to this, in Comparative Example No. 11 according to the prior art, hot dip galvannealed steel plate was produced by changing the steel type from the Test Material 1 to the Test Material 2, but it was not possible to optimally soak the Test Material 2. The alloy layer of the produced hot dip galvannealed steel plate ended up becoming an excessive Γ-phase state.

Further, consider the case of changing the line speed among the conditions when producing hot dip galvannealed steel plate. As shown in Table 2, in Example No. 5 according to the present invention using the Test Material 2, the line speed was lowered to 115 (m/min) compared with the 142 (m/min) of Example No. 4 using the same Test Material 2. In this case as well, by adjusting the ratio of the soaking region and cooling region in the soaking/cooling furnace, it was possible to optimally soak the Test Material 2 and produce hot dip galvannealed steel plate having an optimum alloy layer.

Example II

Next, the case of using a soaking/cooling furnace for cooling, then soaking steel plate will be explained. The results of using the production facility of the present invention and a conventional type production facility to produce hot dip galvannealed steel plate from the test materials of the steel types of the compositions shown in Table 3 under various types of production conditions are shown in Table 4. Note that the length in the line direction of the soaking furnace of the production facility of the present invention was made 25 m. The conventional type production facility had a length in the line direction of the fixed type soaking furnace of 14.2 m and a length in the line direction of the fixed type cooling furnace of 10.8 m. Further, the Al concentration in the plating bath was made 0.134 mass % in both of the production facility of the present invention and the conventional type production facility.

TABLE 3

| | C | Si | Mn | P | S |
|---|---|---|---|---|---|
| Test Material 3 | 0.002 | 0.003 | 0.8 | 0.035 | 0.013 |

* Compositions are all mass % appearance and should be held at a suitable temperature to form a mainly $\delta_1$-phase alloy layer. As shown in Table 4, in Example Nos. 12 and 13 according to the present invention using the Test Material 3, if using the production facility of the present invention, even if changing the line speed to 140 (m/min) and 105 (m/min) like in the above examples, by adjusting the ratio of the soaking region and cooling region in the soaking/cooling furnace, it was possible to constantly maintain the optimum exit side temperature of the rapid heating furnace and holding temperature after cooling at the soaking/cooling furnace. Due to this, it was possible to produce hot dip galvannealed steel plate having the optimum alloy layer.

As opposed to this, in Comparative Example No. 14 according to the prior art using the Test Material 3, even with the same exit temperature of the rapid heating furnace as Nos. 12 and 13, that is, 553° C., if not cooling the steel plate but holding it at the holding temperature of 553° C. in the soaking/cooling furnace, the excessive amount of Fe is outburst and the alloy layer of the hot dip galvannealed steel plate becomes poor in appearance.

Further, in Comparative Example No. 15 according to the prior art using the Test Material 3, if suppressing outbursting of excessive Fe by lowering the exit temperature of the rapid heating furnace to 530° C., the amount of diffusion of the Fe is insufficient, so the alloy layer of the hot dip galvannealed steel plate becomes poor in alloying.

Further, Comparative Example Nos. 16 and 17 according to the prior art using the Test Material 3 show the results of the case of arrangement a fixed type cooling furnace at the exit side of the rapid heating furnace. If trying to maintain the optimum holding temperature after cooling of the steel plate, adjustment of the line speed becomes necessary. Therefore, the line speeds of Nos. 16 and 17 were respectively made 140 (m/min) and 105 (m/min). In this case, in No. 16, the plate could be held at the optimum holding temperature and hot dip galvannealed steel plate having an optimum alloy layer could be produced. However, in No. 17, the holding temperature was insufficient and the amount of diffusion of Fe was insufficient, so the alloy layer of the hot dip galvannealed steel plate became poor in alloying.

TABLE 4

| | | | Plating | Rapid heating furnace | | | Hot idling/cooling furnace | | | | | | |
|---|---|---|---|---|---|---|---|---|---|---|---|---|---|
| | No. | Steel type | deposition ($g/m^2$) | Entry side plate temp. (° C.) | Heating rate (° C./sec) | Exit side plate temp. (° C.) | Entry side plate temp. (° C.) | Cooling rate (° C./sec) | Cooling time (S) | Holding temp. (° C.) | Alloy layer eval. | Line speed (m/min) | Remarks |
| Inv. ex. | 12 | Test Material 3 | 47 | 420 | 47.7 | 553 | | 15 | 3 | 508 | ○ | 140 | |
| | 13 | Test Material 3 | 47 | 420 | 35.8 | 553 | | 15 | 3 | 508 | ○ | 105 | |
| Comp. Ex. | 14 | Test Material 3 | 49 | 420 | 47.7 | 553x | | — | — | 553 | X | 140 | |
| | 15 | Test Material 3 | 46 | 420 | 39.5 | 530 | | — | — | 530 | X | 140 | |
| | 16 | Test Material 3 | 46 | 420 | 47.7 | 553 | | 15 | 3 | 508 | ○ | 140 | |
| | 17 | Test Material 3 | 47 | 420 | 35.8 | 553 | | 15 | 4 | 493 | Δ | 105 | |

In the evaluation of the alloy layers in Table 4, cases where the alloy layer of the produced hot dip galvannealed steel plate is the optimal alloy layer mainly comprised of the $\delta_1$-phase are indicated by the "○" mark, cases where the ζ-phase and Γ-phase are excessive are indicated by the "Δ" mark, and cases where there are nonalloying defects are indicated by the "X" mark.

Depending on the steel type, after making a suitable amount of Fe outburst into the alloy layer by the initial heating, sometimes the steel plate should be immediately cooled to prevent excess Fe from outbursting and causing poor

INDUSTRIAL APPLICABILITY

The present invention is particularly useful for the production facility of hot dip galvanized steel plate for producing hot dip galvannealed steel plate.

According to the present invention, when producing hot dip galvannealed steel plate, by suitably setting the regions of the soaking zone for soaking the heated steel plate and the cooling zone for cooling it and the layout of the soaking region and cooling region to meet with rapid changes in the steel type, plating deposition, and other external factors, it is possible to more easily produce hot dip galvannealed steel plate by constantly optimum production conditions and possible to produce high quality hot dip galvannealed steel plate superior in sliding performance and adhesion. In particular, the response when setting the regions of the soaking zone and cooling zone and the layout of the soaking region and cooling region is high, so operation becomes easier.

The invention claimed is:

1. A production facility of hot dip galvannealed steel plate dipping steel plate in a plating bath, then alloying it, said production facility of hot dip galvannealed steel plate comprising:

a rapid heating furnace set above a plating bath tank, and a soaking/cooling furnace set above said rapid heating furnace and being comprised of a soaking region and a cooling region, said soaking/cooling furnace comprising a pair of hot-air heat sources at the entry side of the soaking/cooling furnace, pairs of exhaust devices and pairs of spray nozzles for spraying cooling gas, said pair of hot-air heat sources, said pairs of exhaust devices and said pairs of spray nozzles being provided along a vertical or line direction arranged facing two surfaces of the steel plate as it is running, wherein said pairs of exhaust devices and said pairs of spray nozzles are alternately arranged at predetermined intervals along the line direction through said soaking/cooling furnace, and said pair of hot-air heat sources, said pairs of exhaust devices and said pairs of spray nozzles are configured to be independently controlled in operation for each facing pair, said pairs of exhaust devices can be individually opened or closed to switch between an exhaust state and a closed state, a ratio of lengths of the two regions in the furnace being freely settable, a layout of said soaking region and cooling region being freely settable, and having an air curtain in said soaking/cooling furnace wherein said spray nozzles are configured with ejection ports able to rotate about an axis parallel to a width direction of the steel plate and said spray nozzles at the boundary of said soaking region and said cooling region can spray cooling gas vertical to the steel plate and form a barrier to the flow of gas.

2. A production facility of hot dip galvannealed steel plate as set forth in claim 1, wherein said hot-air heat source has blower devices for heating the steel plate by hot air.

3. A production facility of hot dip galvannealed steel plate as set forth in claim 1, wherein a separate furnace having no cooling capabilities for soaking the steel plate at 500° C. to 650° C. is arranged between said rapid heating furnace and said soaking/cooling furnace.

4. A production facility of hot dip galvannealed steel plate as set forth in claim 1, wherein exhaust devices are provided in said soaking/cooling furnace at locations to become a boundary between said soaking region and said cooling region.

5. A production facility of hot dip galvannealed steel plate as set forth in claim 1, wherein exhaust devices are provided in said soaking/cooling furnace at a top of said soaking/cooling furnace and at locations to become a boundary between said soaking region and said cooling region.

* * * * *